US005617189A

United States Patent [19]

De Cock et al.

[11] Patent Number: 5,617,189

[45] Date of Patent: Apr. 1, 1997

[54] DEVELOPING UNIT FOR THOROUGHLY SUPPLYING MIXED TONER IN AN ELECTROSTATOGRAPHIC PRINTER

[75] Inventors: Etienne M. De Cock; Lucien A. De Schamphelaere, both of Edegem; Bart J. Van Dessel, St.-Antonius; Daniël L. Van Hoogten, Heist-Op-Den-Berg, all of Belgium

[73] Assignee: Xeikon N.V., Mortsel, Belgium

[21] Appl. No.: 398,906

[22] Filed: Mar. 6, 1995

[30] Foreign Application Priority Data

Mar. 11, 1994 [EP] European Pat. Off. ..... 94301784

[51] Int. Cl.[6] ..... G03G 15/06

[52] U.S. Cl. ..... 399/254; 222/DIG. 1; 399/274; 399/276; 399/259

[58] Field of Search ..... 355/245, 260, 355/251, 253, 246; 222/DIG. 1; 118/653, 656, 657, 658, 689

[56] References Cited

U.S. PATENT DOCUMENTS

| | | | |
|---|---|---|---|
| 3,664,299 | 5/1972 | Shaler et al. | 118/652 |
| 4,721,982 | 1/1988 | Ueda . | |
| 4,800,412 | 1/1989 | Ueda . | |
| 4,960,069 | 10/1990 | Kaieda | 118/657 |
| 4,967,691 | 11/1990 | Chikama et al. | 118/656 |
| 4,996,565 | 2/1991 | Herley | 355/245 |
| 5,005,517 | 4/1991 | Fukui et al. | 118/689 |
| 5,166,732 | 11/1992 | Fuji | 355/245 |
| 5,196,890 | 3/1993 | Nakayama et al. | 355/259 |
| 5,294,968 | 3/1994 | Ueda et al. | 355/245 |
| 5,345,298 | 9/1994 | Corrigan, Jr. | 355/260 |

FOREIGN PATENT DOCUMENTS

| | | |
|---|---|---|
| 0568924 | 11/1993 | European Pat. Off. . |
| 62-73284 | 4/1987 | Japan . |
| 62-288871 | 12/1987 | Japan . |

*Primary Examiner*—Thu A. Dang

*Attorney, Agent, or Firm*—Brumbaugh, Graves, Donohue & Raymond

[57] ABSTRACT

A developing unit including a housing having an opening defining a developing zone, an applicator for applying particulate developer through the opening towards an electrostatographic image to be developed, and a paddle wheel for agitating developer within the housing, for scooping up developer from within the housing and projecting scooped-up developer towards the applicator. A hopper, located outside the width of the development zone supplies toner to the housing, and a primary spiral screw conveys developer from the hopper across the width of the development zone in one direction, while a secondary spiral screw receives developer from the primary spiral screw and conveys developer across the width of the development zone in an opposite direction. A passageway outside the width of the development zone enables the return of developer from the secondary spiral screw to the primary spiral screw.

23 Claims, 5 Drawing Sheets

DEVELOPING UNIT FOR THOROUGHLY SUPPLYING MIXED TONER IN AN ELECTROSTATOGRAPHIC PRINTER

FIELD OF THE INVENTION

The present invention relates to a developing unit suited for developing an electrostatic latent image with dry pulverant two-component developer.

BACKGROUND OF THE INVENTION

In electrostatographic printing machines an electrostatic charge image is formed on a dielectric recording member that may be a photoconductive dielectric recording member which after being uniformly charged is image-wise exposed to conductivity-increasing radiation producing thereby a "direct" or "reversal" toner-developable charge pattern on the recording member.

In one type of development of electrostatic charge images a two-component developer is used in which coloring particles, called toner particles, are mixed with larger magnetizable carrier particles, to which the toner particles adhere by electrostatic attraction force. The electrostatic charge of the toner and carrier particles is obtained triboelectrically by agitation. The charge sign of the toner particles is opposite to the charge sign of the carrier particles. In most commercial copying and printing machines negatively charged toner is used.

It is common practice to apply the toner-carrier mixture to the surface carrying the electrostatic charge image by means of a developing unit wherein toner and magnetizable carrier particles are mixed and a layer of the toner-carrier mixture, referred to herein as "developer" is picked up by an applicator such as a rotating sleeve or drum having magnets inside, forming a so-called magnetic brush on a "magnetic roller".

On rotating the magnetic roller, the toner particles still adhering to the magnetically attracted carrier particles are brought into a developing zone wherein the toner particles are separated from the carrier particles by the electrostatic attraction forces of the electrostatic latent image to be developed and transfer to the latent electrostatic charge image. A developing bias voltage of suitable polarity applied between the magnetic brush and the recording member to be developed decides whether the development is a "direct" or "reversed" development.

The magnetic brush, from which toner particles are removed during each revolution, to be taken up by the developed electrostatic charge image, has to be supplied with fresh toner-carrier mixture. This is normally done by an agitator projecting or scooping up toner-carrier mixture onto the magnetic roller from a housing for holding the developer. The partly exhausted developer is returned to the bulk of developer contained in the housing and has to be thoroughly mixed timely with freshly added toner to keep the toner-carrier weight ratio within acceptable limits for obtaining consistent development results.

It is known, for example from U.S. Pat. No. 4,576,466 (Fukuchi/Konishiroku Photo Industry), to provide a toner supply hopper on one side of the width of an area to be developed. The hopper supplies toner in response to a toner replenishment signal when the density of the image pattern becomes too low. The toner thus supplied is conveyed along a gutter-like conveyance guide or receptacle in the direction of the width of the area to be developed by means of a spiral screw. The toner is replenished through toner dropping holes provided substantially under the conveyance guide.

In order to obtain even distribution of developer particles, a pair of screw members has been proposed as described in U.S. Pat. No. 4,576,466. The invention disclosed therein deals with a solution to the problem of obtaining a sufficiently thoroughly mixed toner-carrier developer composition in the developing unit. The developing system proposed includes agitating means arranged between the secondary screw member means and the applicator, the agitating means including means for scooping up developer to fly onto the primary screw member to mix with developers supplied from a supply means.

In PCT patent application W0 93/09475 (Fujitsu Limited) a developing unit is described in which two screw members are provided to distribute a two-component developer across the unit. The two screw members are separated by a partition which extends across a central portion of the unit, but allows communication between the two screw members at each end thereof, enabling circulation of at least part of the developer in the unit.

Although the above described developing systems already gives a substantial improvement in toner-carrier mixing and developing reproducibility, further improvements can be made with regard to mixing efficiency and the prevention of damming up toner-carrier mixture at the downstream end of the secondary screw member.

SUMMARY OF THE INVENTION

It is an object of the present invention to provide a developing unit by means of which high quality and reproducible image development results can be obtained with a developer containing thoroughly mixed toner and carrier particles inside the unit.

It is a particular object of the present invention to provide such a developing unit wherein thorough mixing of toner and carrier particles takes place without damming up of these particles of the unit.

According to the invention there is provided a developing unit for use in an electrostatographic printer comprising:

(i) a housing having an opening defining a developing zone;

(ii) an applicator for applying particulate carrier/toner developer through the opening towards an electrostatographic image to be developed;

(iii) agitator means for agitating developer within the housing (1), for scooping up developer from within the housing (1) and projecting scooped-up developer towards the applicator;

(iv) supply means located outside the width of the development zone for supplying toner to the housing (1);

(v) primary conveyance means for conveying developer from the supply means across the width of the development zone in one direction;

(vi) secondary conveyance means for receiving the developer from the primary conveyance means across the width of the development zone and for conveying developer across the width of the development zone in a direction opposite and substantially parallel to the conveyance direction of the primary conveyance means, wherein the primary and secondary conveyance means each define a respective developer transport path interconnected by a passageway outside the width of the development zone enabling the return of developer from the secondary to the primary conveyance means.

Preferably, the applicator comprises a rotatable developing sleeve having magnets located therein for attracting developer onto the sleeve. The primary conveyance means is preferably adapted for conveying developer in the one direction substantially in parallel with the axis of rotation of the developing sleeve.

In a preferred embodiment, the housing has an extension protruding beyond one side of the developing zone, the extension comprising first and second channels into the first of which an end part of the primary conveyance means extends and into the second of which an end part of the secondary conveyance means extends. The first and second channels may be substantially parallel to each other. The channels may be interconnected by the passageway. The supply means may open through an entrance opening into the first channel. The developing unit may further comprise means to resist the flow of developer in the first channel, at a position downstream of the entrance opening, such as one or more magnets producing a static magnetic field penetrating into the first channel.

The primary and secondary conveyance means are preferably in the form of screws with an end portion of the secondary conveyance means extending beyond the passageway outside the width of the developing zone and the end portion has a screw thread reversed in direction with respect to screw thread direction of the remainder of the secondary conveyance means, thereby to convey developer into the passageway substantially without damming-up of developer at the secondary conveyance means end.

The first conveyance means is preferably screened from the agitator means to prevent the agitating means from projecting scooped-up developer onto the primary conveyance means.

In preferred embodiments of the invention, the agitating means is a rotatable paddle wheel and means are provided for rotating said paddle wheel in the same sense as the rotation of the developing sleeve. The developing sleeve may be associated with a doctor blade for determining the thickness of a developer layer formed on the sleeve in the developing zone. The doctor blade preferably extends along the developing sleeve in a direction parallel to the axis thereof, and the blade is connected over its whole length to a plate following a part of the circumference of the sleeve.

In an operational orientation of the unit, the primary conveyance means is preferably located above the secondary conveyance means and the unit further comprises a first gutter positioned under the primary conveyance means and interposed between the primary conveyance means and secondary conveyance means. To enable the secondary conveyance means to receive developer from the primary conveyance means across the width of the development zone, the gutter may have a plurality of holes therethrough positioned along its length to allow portions of developer conveyed by the primary conveyance means to fall onto the secondary conveyance means. Alternatively, the gutter may have a side wall the height of which decreases in the conveyance direction of the primary conveyance means, said side wall constituting a dam over which portions of developer conveyed by the primary conveyance means to fall onto the secondary conveyance means. This construction has an advantage over the provision of holes in the gutter, since holes may become blocked or partially blocked in time, resulting in uneven distribution of the developer.

A second gutter may be positioned above the agitating means extending in a direction parallel to the axis of the developing sleeve, the second gutter having a plurality of holes therethrough positioned along its length to allow portions of developer removed from the developing sleeve by the doctor blade to fall back towards the agitating means. The second gutter is preferably joined to the first gutter by a wall which serves to prevent scooped-up developer from being projected onto the primary conveyance means.

The supply means may comprise a hopper for fresh toner.

The unit may further comprise sensing means for sensing the concentration of toner in the developer in the passageway, the sensing means preferably comprising means for measuring the magnetic permeability of the developer in the passageway. Alternatively, optical sensing devices may be used. Thus a convenient solution is provided to the problem of consistently measuring the toner concentration in the carrier-toner mixture residing in the developing unit. In a particular embodiment, the supply means is sensitive to the output of the sensing means to dose toner to the housing in such a manner as to maintain the carrier/toner ratio of the developer within the housing at a substantially constant level.

In alternative embodiments of the invention the supply means may comprise a vessel capable of containing a larger volume of developer than the housing, the supply vessel being connected between the first and second channels to enable at least a portion of developer to be recycled through the vessel.

BRIEF DESCRIPTION OF THE DRAWINGS

The invention will now be described, purely by way of example, with reference to the accompanying drawings in which.

DESCRIPTION OF PREFERRED EMBODIMENTS

Figure 1:
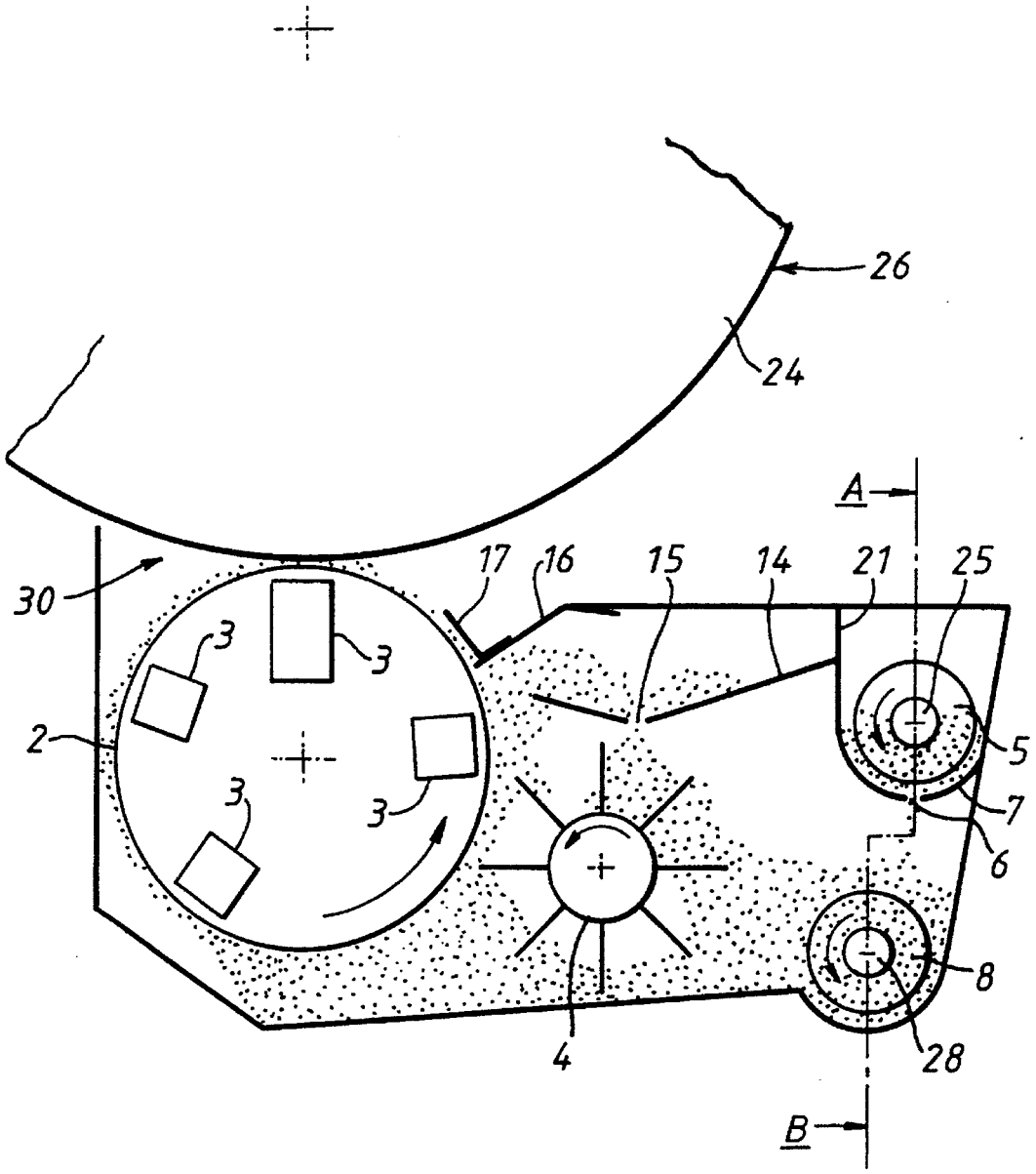
FIG. 1 is a cross-sectional view seen from one side, illustrating a dry toner two-component type developing unit according to the present invention in operational relationship with a photoconductive drum (partly shown in the drawing)

The Figures show a developing unit for use in an electrostatographic printer. The developing unit shown by sectional view in the FIGS. 1 and 2 comprises a housing or casing 1. The housing 1 has an opening 30 in its upper wall, the opening being directed towards a photoconductive drum 24 (partly shown in the drawing) which carries an electrostatic image to be developed on its surface 26. The width of the opening 30 defines a developing zone Z (see FIG. 1). A rotary developing sleeve 2 having built-in magnets 3 (which in the embodiment shown in FIG. 2 are stationary magnets) is located in the housing 1, adjacent the opening 30. Agitating means in the form of a paddle wheel 4 is provided for agitating the bulk of the carrier-toner mixture inside the housing near developing sleeve 2. The paddle wheel 4 has radially extending blades which are optionally inclined or curved for better scooping up developer onto the developing sleeve 2.

The housing 1 also contains a rotatable primary spiral screw 25 and a secondary spiral screw 28, separated by a gutter 7, the secondary spiral screw 28 being immersed in the bulk of carrier-toner mixture in the housing 1. At least within the developing zone Z, the spiral screws are formed of non-magnetic material, such as for example a plastics material or non-magnetic alloy. The primary spiral screw 25 conveys carrier-toner mixture across the unit in one direction, parallel to the axis A of the developing sleeve 2 (indicated in FIG. 1A) along the width of the developing zone Z away from the right hand end thereof as viewed in FIG. 2. This developer is distributed through holes 6 arranged in the gutter 7 onto the secondary spiral screw 28. The secondary spiral screw 28 is mounted substantially under the primary spiral screw 25, and in parallel therewith. The secondary spiral screw 28 conveys the carrier-toner mixture received from the primary spiral screw 25, together with part of the bulk developer within the housing, across the unit in the opposite direction parallel to the axis A of the developing sleeve 2 along the width of the developing zone Z towards the right hand end thereof as viewed in FIG. 2. The right hand ends of the primary and secondary spiral screws 25 and 28 extend beyond the developing zone Z into an extension 10 (shown in dashed lines in FIG. 2) of the housing, where they are located in first and second cavities or channels 11 and 12 respectively, the channels 11 and 12 taking the form of cylindrical holes. A passageway 9 is located in the extension 10 of the housing 1 and communicates the two channels 11 and 12 for recycling carrier-toner mixture.

Channel 11 has an entrance opening 13 that serves to feed therethrough fresh toner for conveyance by the primary spiral screw 25. The entrance opening is connected to a supply conduit of a hopper 20 containing fresh toner.

During operation of the developing unit, the primary spiral screw 25 is rotated in such a sense that the screw thread 5 thereof conveys the carrier-toner mixture in one direction substantially in parallel with the axis A of rotation of the developing sleeve 2. The secondary spiral screw 28 is arranged substantially in parallel to the primary spiral screw 25 and is rotated in such a sense that the screw thread 8 thereof causes developer received through the holes 6 and developer coming from the paddle wheel along the developing sleeve 2 to be conveyed in a direction opposite to the conveyance direction of the primary spiral screw 25. The secondary spiral screw is buried under developer powder present at the start of the development at the bottom of the housing 1.

By the presence of a reversed spiral structure **8*a* at the end part 28*a* of the secondary spiral screw 28 in the channel 12, toner-carrier mixture is pumped up into the passageway 9 and no damming up of toner-carrier mixture in the channel 12** can take place.

Figure 3:
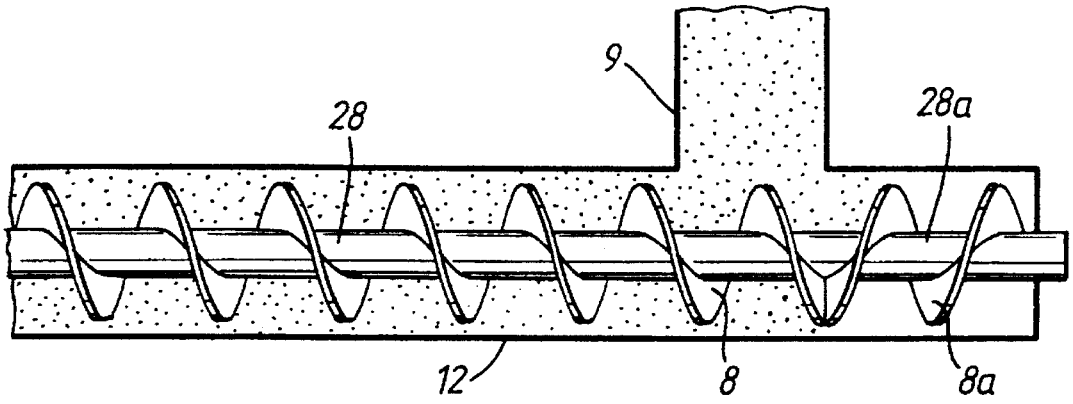
FIG. 3 is a partial front view illustrating an end part of the spiral screw serving as secondary conveyance means which extremity part is located in a channel of an extension of the housing of the developing unit.

FIG. 3 gives a partial front view illustrating the end part **28*a* of the secondary spiral screw 28 located in the channel 12. That part 28*a* of the secondary spiral screw 28 which extends beyond the passageway 9 has a screw thread 8*a* with a reversed spiralling sense with respect to the screw thread 8 of the remainder of the secondary spiral screw 28**, as shown in the drawing.

As can be seen from FIG. 2, the gutter 7 is joined to another gutter 14 that is in parallel position with respect to the developing sleeve 2 and extends above the paddle wheel 4. The gutter 14 has a plurality of holes 15 therein, allowing any part of the developer not picked up by the developing sleeve 2 and/or removed therefrom by a doctor blade 16 to drop down towards the paddle wheel 4. The gutter 14 joined to the gutter 7 by a separation wall 21, which serves to prevent scooped-up developer from being projected onto the primary spiral screw 25.

A doctor blade 16 determines the thickness of the developer layer on the developing sleeve 2 in the developing zone Z. The doctor blade 16 extends in parallel position along the developing sleeve 2, and is connected over the whole of its length to a plate 17 following a part of the circumference of the sleeve 2. The plate 17 serves for counter-acting toner dust circulation in the atmosphere of the housing 1 and prevents the escape of developer from the sleeve just beyond the doctor blade 16.

The developing unit has at least one a stationary permanent magnet 18 (only one is shown in FIG. 2) positioned adjacent the channel 11 at a position downstream of the entrance opening 13. By the magnetic field of the magnet(s) 18 a flow resistance is built up for the magnetically susceptible carrier particles of the developer and consequently also for the toner particles that electrostatically cling thereto. The flow resistance results in a better mixing of toner and carrier particles and into a more homogeneous developer. As an alternative to the permanent magnet 18 located outside the channel 11, one may utilize a coil fed with direct current or even a permanent magnet located within the spiral screw 25 itself.

As shown schematically in FIG. 2, in an embodiment of a developing unit according to the present invention, the passageway 9 between the secondary and the primary spiral screws is provided with a sensor 19 yielding signals determinative for the concentration of toner in the carrier-toner mass. For example, the sensor 19 may be a TC (toner concentration) sensor which measures the magnetic permeability of the carrier-toner mass in the passageway 9. After calibration, the magnetic permeability values can be translated into toner concentration values. The signals obtained from the sensor may be used to control the feeding of fresh toner from hopper 20 into the developing unit. The location of the sensor 19 in the passageway 9 is very convenient for an undisturbed measurement under circumstances wherein the packing density of the developer passing through the passageway 9 remains almost constant and is not influenced by moving elements inside the unit.

In an alternative embodiment of the invention not fully shown in the drawings, toner-carrier mixture is added through the entrance opening 13 and an overflow exit 22 opening from channel 12 allows recycling of the mixture through a supply vessel connected thereto.

Figure 1A:
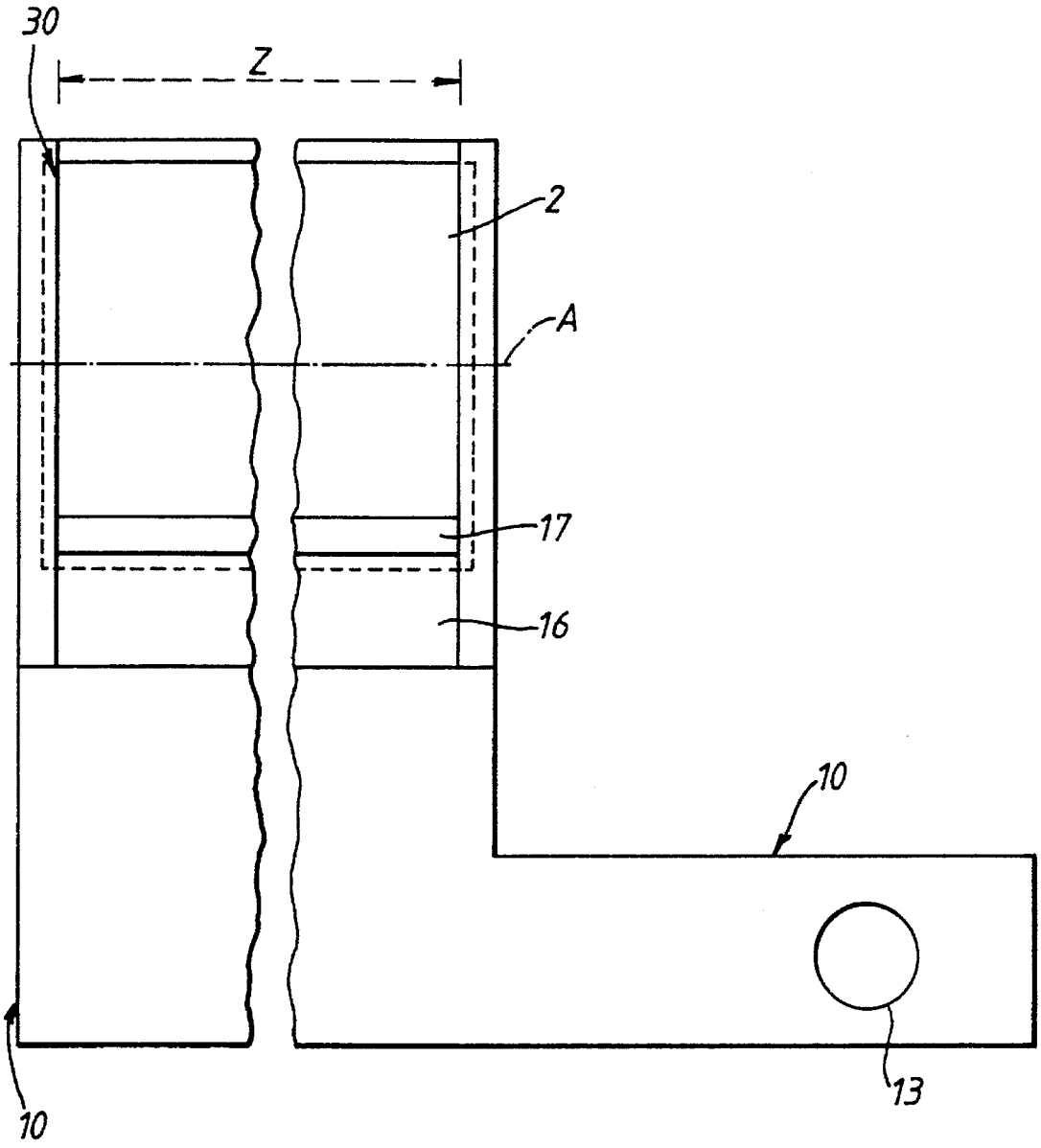
FIG. 1A is a view of the developing unit shown in FIG. 1 taken from above, with the photoconductive drum removed for the sake of clarity.
Figure 2:
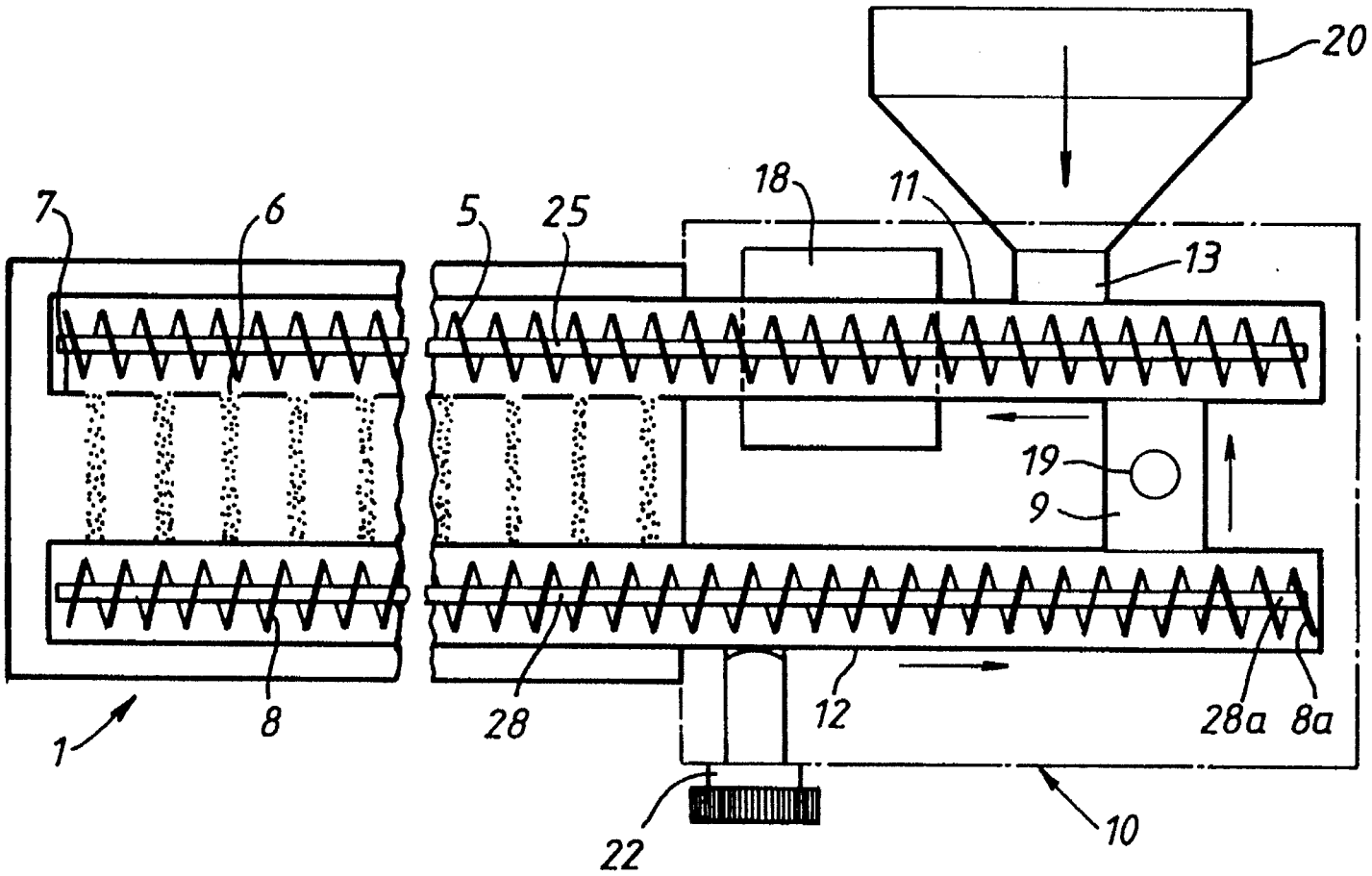
FIG. 2 is a schematic cross-sectional view taken along the line A–B of the same unit illustrated in FIG. 1.

In the alternative embodiment shown in FIGS. 4 and 5, features similar to those of the embodiment described with reference to FIGS. 1 to 3 are given similar reference numbers. This embodiment however differs as follows. The gutter 7 has a side wall 31 the height of which decreases in the conveyance direction of the primary spiral screw 25, the side wall 31 constituting a dam over which portions of developer conveyed by the primary spiral screw 25 fall onto the secondary spiral screw 28. This construction has an advantage over the provision of holes in the gutter, as in the embodiment of FIGS. 1 to 3, since holes may become blocked or partially blocked in time, resulting in uneven distribution of the developer.

Figure 4:
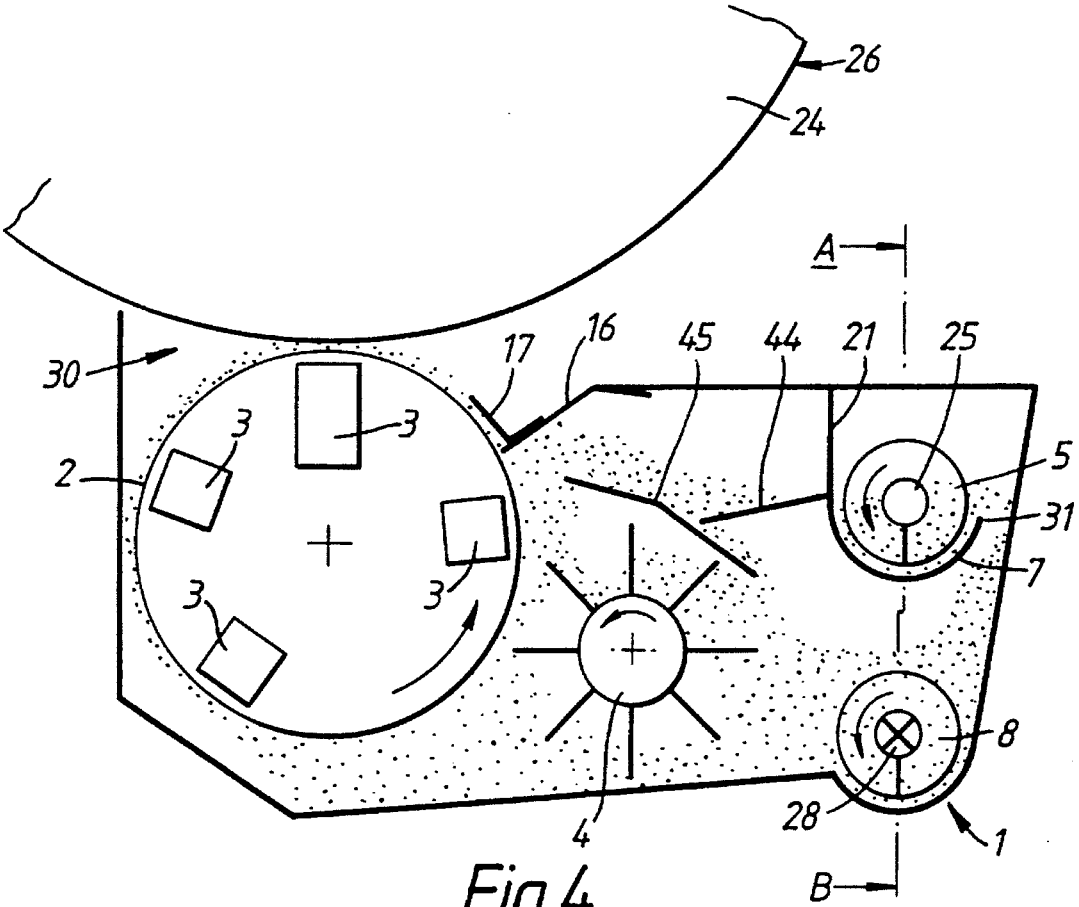
FIG. 4 is a view similar to FIG. 1 of an alternative embodiment of the present invention.
Figure 5:
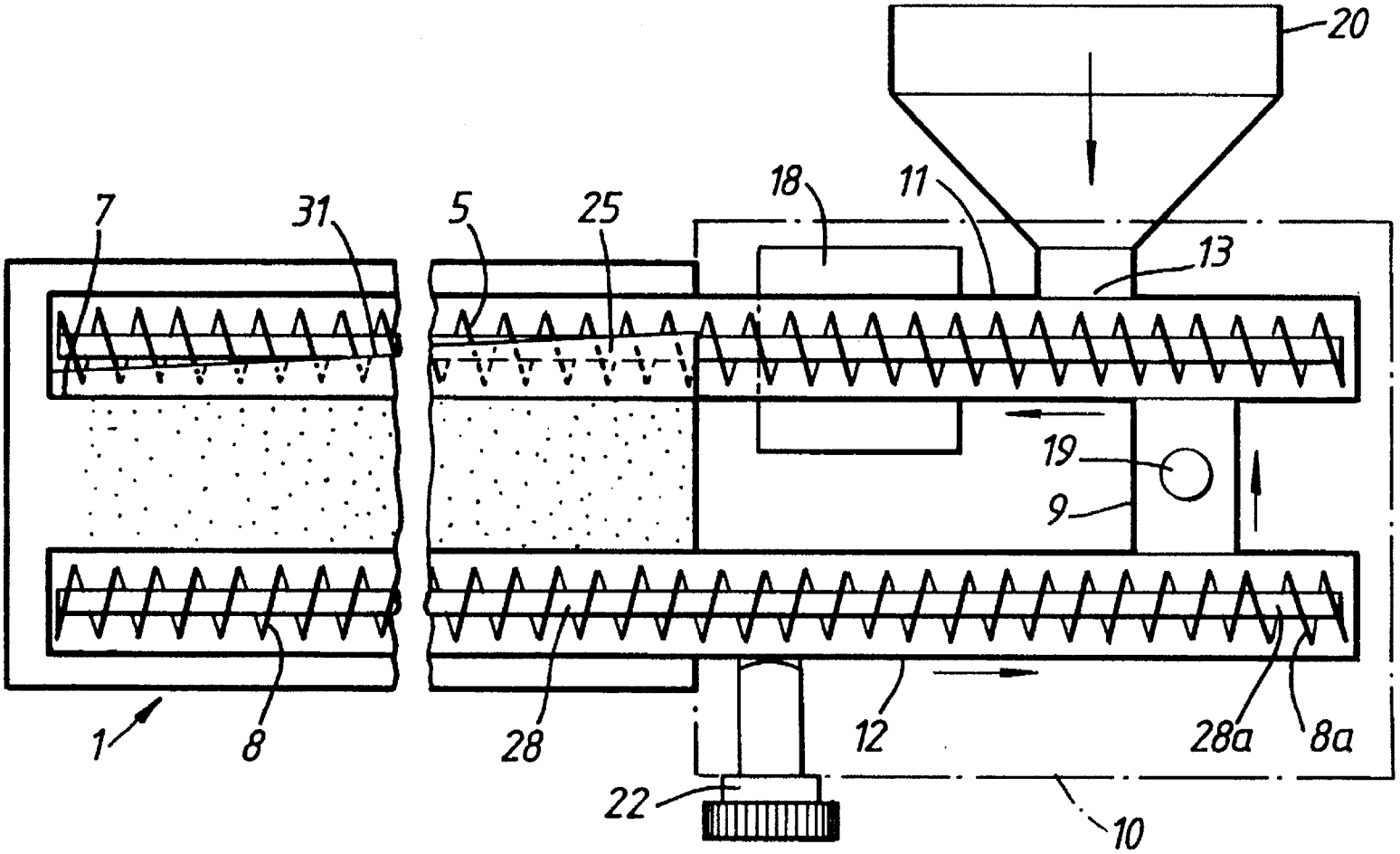
FIG. 5 is a view similar to FIG. 3, of the alternative embodiment shown in FIG. 4.

As can be seen from FIG. 4, the gutter 7 is joined to another gutter 44 that is in parallel position with respect to the developing sleeve 2 and extends above the paddle wheel 4. The gutter 44 is spaced from a plate 15, which is so positioned as to ensure that any part of the developer not picked up by the developing sleeve 2 and/or removed therefrom by a doctor blade 16 falls down towards the paddle wheel 4 on that side thereof which is towards the secondary spiral screw 28.

We claim:

1. A developing unit for use in an electro-statographic printer comprising:

(i) a housing having an opening defining a developing zone and an extension protruding beyond one side of said developing zone, said extension having first and second channels, said first channel located above said second channel;

(ii) an applicator for applying particulate carrier/toner developer through said opening towards an electrostatographic image to be developed;

(iii) agitator means for agitating developer within said housing, for scooping up developer from within said housing and projecting scooped-up developer towards said applicator;

(iv) supply means located outside the width of said development zone for supplying toner to said housing;

(v) primary conveyance means for conveying developer from said supply means across the width of said development zone in one direction, an end part of said primary conveyance means extending into said first channel of said extension;

(vi) secondary conveyance means for receiving said developer from said primary conveyance means across the width of said development zone and for conveying developer across the width of said development zone in a direction opposite and substantially parallel to the conveyance direction of said primary conveyance means, an end part of said secondary conveyance means extending into said second channel of said extension;

wherein said primary and secondary conveyance means each define a respective developer transport path interconnected by a passageway outside the width of said development zone enabling the return of developer from said secondary to said primary conveyance means.

2. A developing unit according to claim 1, wherein said applicator comprises a rotatable developing sleeve having magnets located therein for attracting developer onto said sleeve.

3. A developing unit according to claim 2, wherein said primary conveyance means is adapted for conveying developer in said one direction substantially in parallel with the axis of rotation of said developing sleeve.

4. A developing unit according to claim 1, wherein said first and second channels are in the form of cylindrical holes.

5. A developing unit according to claim 4, wherein said first and second channels are substantially parallel to each other.

6. A developing unit according to claim 4, wherein said supply means opens through an entrance opening into said first channel.

7. A developing unit according to claim 4, wherein said supply means comprises a vessel capable of containing a larger volume of developer than said housing, said supply vessel being connected between said first and second channels to enable at least a portion of developer to be recycled through said vessel.

8. A developing unit according to claims 6, further comprising flow resistance means to resist the flow of developer in said first channel, at a position downstream of said entrance opening.

9. A developing unit according to claim 8, wherein said flow resistance means comprises at least one magnet producing a static magnetic field penetrating into said first channel.

10. A developing unit according to claim 1, wherein said primary and secondary conveyance means comprise screws and wherein an end portion of said secondary conveyance means extends beyond said passageway outside the width of said developing zone and said end portion has a screw thread reversed in direction with respect to the direction of said screw thread of the remainder of said secondary conveyance means, thereby to convey developer into said passageway substantially without damming-up of developer at said secondary conveyance means end.

11. A developing unit according to claim 1 wherein said first conveyance means is screened from said agitator means to prevent said agitating means from projecting scooped-up developer onto said primary conveyance means.

12. A developing unit according to claim 1, wherein said agitating means comprises a rotatable paddle wheel and means for rotating said paddle wheel in the same sense as the rotation of said developing sleeve.

13. A developing unit according to claim 1, wherein said developing sleeve is associated with a doctor blade for determining the thickness of a developer layer formed on said sleeve in said developing zone.

14. A developing unit according to claim 13, wherein said doctor blade extends along said developing sleeve in a direction parallel to the axis thereof, and said blade is connected over its whole length to a plate following a part of the circumference of said sleeve.

15. A developing unit according to claim 1, wherein, in an operational orientation of said unit, developer passes under the influence of gravity from said primary conveyance means to said secondary conveyance means across the width of said development zone.

16. A developing unit according to claim 15, wherein said first channel comprises a first gutter positioned under said primary conveyance means and interposed between said primary conveyance means and secondary conveyance means, and wherein said first gutter has a plurality of holes therethrough positioned along its length to allow portions of developer conveyed by said primary conveyance means to fall onto said secondary conveyance means.

17. A developing unit according to claim 15, wherein said first channel comprises a first gutter positioned under said primary conveyance means and interposed between said primary conveyance means and secondary conveyance means, and wherein said first gutter has a side wall the height of which decreases in the conveyance direction of said primary conveyance means, said side wall constituting a dam over which portions of developer conveyed by said primary conveyance means to fall onto said secondary conveyance means.

18. A developing unit according to claim 16, wherein a second gutter is positioned above said agitating means and extends in a direction parallel to the axis of said developing sleeve, said second gutter having a plurality of holes therethrough positioned along its length to allow portions of developer removed from said developing sleeve by said doctor blade to fall back towards said agitating means.

19. A developing unit according to claim 18, wherein said second gutter is joined to said first gutter by a wall which serves to prevent scooped-up developer from being projected onto said primary conveyance means.

20. A developing unit according to claim 1, wherein said supply means comprises a fresh toner hopper.

21. A developing unit according to claim 1, further comprising sensing means for sensing the concentration of toner in the developer in said passageway.

22. A developing unit according to claim 21, wherein said sensing means comprises means for measuring the magnetic permeability of said developer in said passageway.

23. A developing unit according to claim 22, wherein said supply means is sensitive to the output of said sensing means to dose toner to said housing in such a manner as to maintain the carrier/toner ratio of said developer within said housing at a substantially constant level.

* * * * *